US005511654A

United States Patent [19]

de la Rocha

[11] Patent Number: 5,511,654

[45] Date of Patent: Apr. 30, 1996

[54] SWAB AND SHIELD ASSEMBLY FOR DAUBABLE MATERIAL

[75] Inventor: Daniel de la Rocha, Miami, Fla.

[73] Assignee: Calis Holdings, Inc., Miami, Fla.

[21] Appl. No.: 195,553

[22] Filed: Feb. 14, 1994

Related U.S. Application Data

[63] Continuation-in-part of Ser. No. 63,884, May 18, 1993, Pat. No. 5,330,056.

[51] Int. Cl.[6] ..... A45D 44/18

[52] U.S. Cl. ..... 206/15.3; 206/210; 206/361; 604/1

[58] Field of Search ..... 206/15.2, 15.3, 206/210, 361, 365, 581; 601/1

[56] References Cited

U.S. PATENT DOCUMENTS

| | | | |
|---|---|---|---|
| 3,586,380 | 6/1971 | Allbeckoff | 604/1 |
| 3,759,375 | 9/1973 | Nappi | 206/361 |
| 4,113,090 | 9/1978 | Carstens | 206/365 |
| 4,847,939 | 7/1989 | Derencsenyi et al. | 206/361 |
| 4,952,204 | 8/1990 | Korteweg | 604/1 |
| 5,112,152 | 5/1992 | McBride | 206/361 |

*Primary Examiner*—David T. Fidei
*Attorney, Agent, or Firm*—Malloy & Malloy

[57] ABSTRACT

The present invention relates to a swab and swab shield assembly which is especially useful for applying cosmetics. The assembly is seen to comprise a swab having a wad at one end and preferably a protective cover or shield for the wad which can be removeably sealed to the swab so that the shield protectively enshrouds the wad. The swab, which is particularly useful as a cosmetic article is seen to comprise an elongate rod with a relatively smooth surfaced wad secured at one end, which wad is preferably a wax-coated, fibrous material onto which is applied a daubable material such as a sample of a cosmetic, such as for example a shade of lipstick, blush and/or eye shadow. The shield for the wad is annular and is preferably slidably moveable along the elongate rod between a first position protectively enshrouding the wad and an axially displaced position along the swab handle wherein the wad can be exposed for use.

18 Claims, 2 Drawing Sheets

SWAB AND SHIELD ASSEMBLY FOR DAUBABLE MATERIAL

CROSS REFERENCE

This application is a continuation-in-part of application Ser. No. 08/063,884, now U.S. Pat. No. 5,330,056 May 18, 1993.

FIELD OF THE INVENTION

The present invention relates to an assembly composed of a swab and swab shield which is especially useful for applying cosmetics.

BACKGROUND OF THE INVENTION

The assembly is composed of a) a swab having a wad mounted on one end, b) a protective cover or shield to protectively enshroud the wad, while in a normal position, and c) means for removably maintaining the swab and shield in general co-axial alignment while in assembly. The shield can be moved relative to the swab, from the normal position protecting the wad to a position exposing the wad for use thereof.

More particularly, the assembly comprises an elongate rod with a wad secured about one rod end, which wad, in a preferred embodiment, is of fibrous material, the same being wax coated and impregnated to provide a smooth outer surface on the fibrous material and to adapt it to "pick up" daubable material. The daubable material can be a cosmetic product such as lipstick, eye shadow, face powder, and the like. Also in the preferred embodiment, the shield for the wad is annular defining a skirt which is slidably movable along the elongate rod between a first or normal position protectively shielding the wad within the skirt and an axially displaced position along the swab handle wherein the smooth wad surface is exposed.

BACKGROUND OF THE RELATED ART

Most women use a variety of daubable cosmetic products daily, such as lipsticks, rouge, blush, eye shadow, eyeliner, moisturizer, foundation, perfume, etc. There are numerous cosmetic manufacturers and moreover, each ordinarily makes a wide variety within each type of cosmetic product, such as assortments of consistencies, amounts of moisturizers or oils used, and, also, a wide selection in terms of color.

As such, it is important to the cosmetic manufacturers that their products be displayed in a way that maximizes the options and appeal of the various products. With many of these cosmetic products such as lipstick, eye shadows, and eyeliners, cosmetic counters typically display an assortment of available colors by way of a color chart and/or actual samples of the product.

For example, lipsticks are usually displayed on a vertically positioned type of stand which displays available lipstick colors on paper or plastic squares; and usually, in each color square, there is a bore into which an actual lipstick tube is placed containing a lipstick sample.

Unfortunately, due to cost considerations and due to available shelf space, there is most often, if not always, only one counter cosmetic sample of each available product. Consequently, each counter sample is used over and over by many different women. Possible contamination of the cosmetic sample is a grave concern in the field and has been a long outstanding problem little spoken about in the field. For example, one lipstick sample may be sampled by many different women not only on their lips, but on the their hands or wrists, on their fingers or even on a tissue. This compounds the fact that the samples are exposed to the air and can freely be infected by germs from coughs and sneezes.

In addition to the attendant risks mentioned above, display costs are exacerbated because the ordinarily small size of cosmetic samples allows them to be easily tucked into handbags or purses without notice and therefore, theft of such samples is commonplace. This theft cost is, also, not often mentioned in public; but it has long been a problem in the field. Moreover, the scrutinizing of consumers so as to guard against theft interferes with the consumer's willingness to sample products because it is both a highly personal and intimate decision.

SUMMARY OF THE INVENTION

This invention largely overcomes these problems. The invention relates to a) a swab and b) a shield protectively about the working end of the swab, namely its wad, and which shield can be moved to expose the wad for use. The invention includes a) a generally elongate swab composed of a daubing means with a relatively smooth surface mounted on one end, b) a shield with an internal recess or belly for protectively enshrouding the swab's daubing wad, the shield being movable to expose the wad; c) means on the shield for engaging the swab's handle to removably maintain said swab, wad and shield, in generally co-axial alignment while in assembly; and d) the swab's handle being used to manipulate movement of the wad out of the belly of to expose said wad for use. Further, the invention preferably includes e) sealing means in the assembly to guard against contamination of the swab.

OBJECTS OF THE INVENTION

With the foregoing in mind, it is an object of the present invention to provide a sanitary and disposable swab article for depositing at least a single use of a cosmetic sample thereon, thereby reducing the cost associated with existing practices of having an entire tube of cosmetic product for samples and theft of such existing sample products.

It is a further and general object of the present invention to provide a sealed swab article and shield assembly for use in depositing a sample thereon to prevent contamination and spreading of germs.

It is a further object of the present invention to provide a disposable swab article including at one end, an enlarged wad coated with daubing means, said daubing means having a relatively smooth surface, for accepting an application of a daubable material thereon, such as a cosmetic sample, and for maintaining the integrity and color of the sample applied thereon so that its oils and colors will not bleed excessively into the wad interior or the elongate stick.

It is a further object of the present invention to provide a swab and shield assembly for protectively enshrouding a wad end of a swab, including daubing means and any daubable material thereon during movement or transportation from one location to another location.

It is a further object of the present invention to provide a swab and shield assembly which is inexpensive to manufacture and which is environmentally friendly.

These and other objects of the invention will be more readily apparent in the description which follows.

BRIEF DESCRIPTION OF THE DRAWINGS

Like reference numerals refer to like parts throughout the several views of the drawings.

DETAILED DESCRIPTION OF THE PREFERRED EMBODIMENTS

Figure 1:
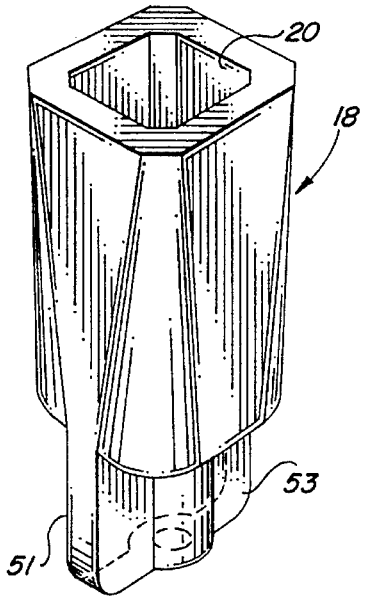
FIG. 1 is a perspective view of a shield for a wad on a swab.
Figure 2:
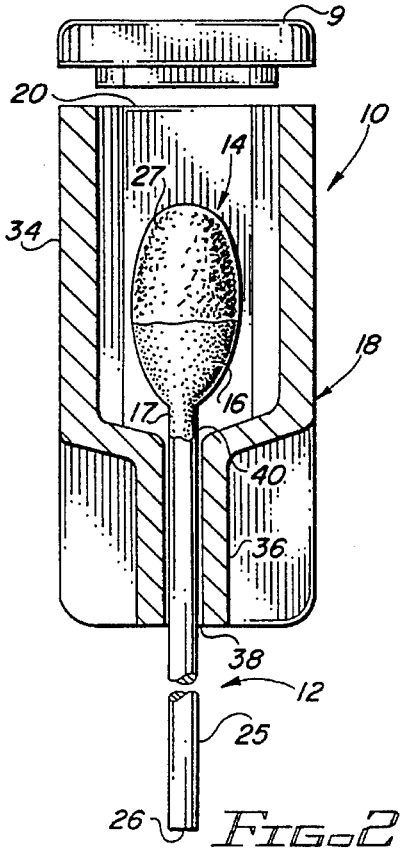
FIG. 2 is a view partially in cross section and illustrating a swab and shield in assembly.
Figure 3:
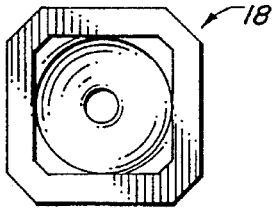
FIG. 3 is a top plan view of the swab shield seen in FIG. 1.
Figure 4:
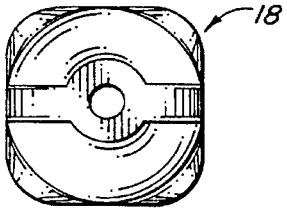
FIG. 4 is a bottom view of the combination shown in FIG. 2.

Referring to the drawings, wherein like reference characters designate like or corresponding parts throughout the several views, and initially, with reference to FIG. 2, there is shown a swab and shield assembly or cosmetic assembly, generally designated by the numeral 10. It is composed of a swab generally designated by the numeral 12 having a daubing wad 14 secured on one end, which will be referred to as the swab's distal end. In FIG. 2, the daub wad 14 is shown to be protectively enshrouded by a tubular shield generally designated by the numeral 18. In the preferred embodiment of the assembly, the shield 18 is axially movable along the swab handle 25 to expose the wad 14 from its protected position in the enlarged upper recess 20 of the shield. Cap or closure means 9 may be provided at the extreme end zone to close the shield recess 20, see FIG. 2 at the top.

Figure 7:
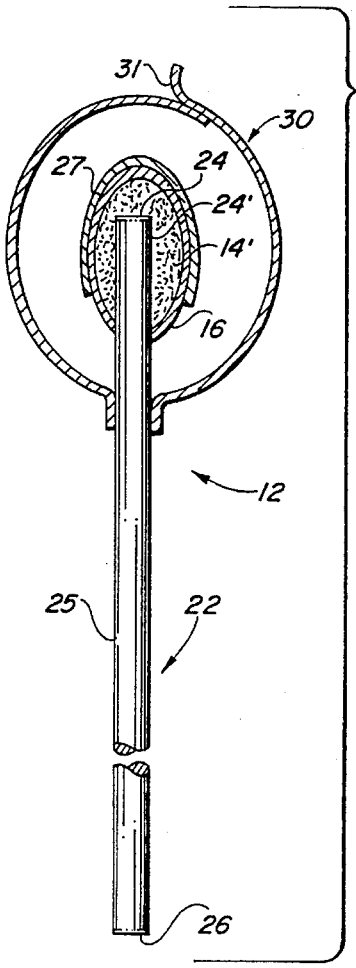
FIG. 7 is a view in cross-section of a swab in accordance with this invention.

Referring now to FIG. 7, a disposable or sample swab 12 is shown. It is seen to comprise an elongate rod 22 having a distal end 24 and a proximal end 26. The elongate rod can be made of wood, plastic or other suitable material. Adjacent the distal end 24 there is a distal end zone 24' extending from the distal end to an elongate swab handle 25.

With further reference to FIG. 7, the distal end zone 24' of the swab is provided with a daubing wad 14 which may be of fibrous material. In such a case and prior to use, the daubing wad can be dipped in a wax-like material to provide a relatively smooth outer daubing surface, although it is contemplated that with developments in technology various other materials may also be used. In a preferred embodiment, the daubing wad 14 is dipped so as to be coated and its surface area impregnated with a wax-like material or outer layer 16. This provides a wad which is soft with a relatively smooth outer surface, comprising in combination a daubing means.

In use, the swab may then be dipped in a daubable material such as powder or a buttery material, such as lipstick, to pick up a coating of the daubable material, the daubable material being indicated by the numeral 27. The melting temperature of the wax-like material 16 of the wad is substantially higher than that of the daubable material. This resists bleeding of the daubable material into the daubing wad in the preferred embodiment which as indicated is of a fibrous material wad dipped in melted wax. A sealing means 30 may be provided to protect the daubing means from contaminants, which sealing means may be of any type conventionally used in the art, such as the indicated envelope 30 with a tab 31 (much like the closure of a cigarette or gum package). The swab handle 25 extends away from the sealing means. In any event, the swab handle can be used to manipulate movement of the wad out of the belly so as to separate the assembly.

Having described the swab 12 on reference to FIG. 7 and the dauber assembly 10 on reference to FIG. 2, generally, reference will now be made with more particularity to the embodiments shown in FIGS. 1–8.

It is seen that the overall length of the handle, see FIG. 2, is substantially greater than the overall length of the shield 18 which protectively enshrouds the daubing means 14. Preferably, the handle 25 is of a substantially uniform cross-sectional area, preferably circular; but, if desired, it may be of a somewhat different configuration to prevent relative twisting of the swab handle and shield. In FIG. 2, some daubable material 27 is indicated on the smooth exterior surface of the daubing means 14.

It will be noted in FIG. 2 that the shield 18 includes an upper or distal tubular portion 34 with a large enough recess 20 to receive, jacket, and protectively enshroud the daubing means and any daubing material such as 27 thereon. The recess may be considered to be a belly 20 with a mouth which can be open or closed. The shield is tubular in a preferred embodiment, and has a through passageway, first, a belly portion 20 (or that part defining the daubing means receiving recess); second, a hub portion designated by the numeral 36; and third, a throat therebetween. The hub portion 36 has a passageway 38 which is preferably sized and configured for snug axial receipt of the swab handle therein. The mutual intercooperation of a) the handle in the hub portion of the passageway 38 and b) the hub passageway surface constitutes mutually intercooperating means to constrain the daubing means and swab to axial movement, generally, relative to each other. It will further be seen that the throat is at a shoulder zone 40 or at the juncture of the belly or enlarged recess 20 and the communicating smaller diameter hub passageway 38 (through the hub 36). This shoulder constitutes an abutment means now to be described. This abutment means acts as a stop against movement of the swab downwardly, or with respect to FIG. 2 because it prevents the daubing swab end 14 from being moved downwardly through the smaller passageway 38, of the hub portion 36. It is seen that the wax coating 16, in the preferred embodiment, extends proximally somewhat from the more enlarged distalmost wad and onto what may be considered to be a proximal zone of the distal end zone, see numeral 17. This wax coating 16 on the distal end zone 17 abuts the shoulder 40 in the normal position shown in FIG. 2. It may also serve as a sealing means when engaged by the shoulder 40, to seal the shield at its passageway 38 from the entrance of contaminants.

Figure 5:
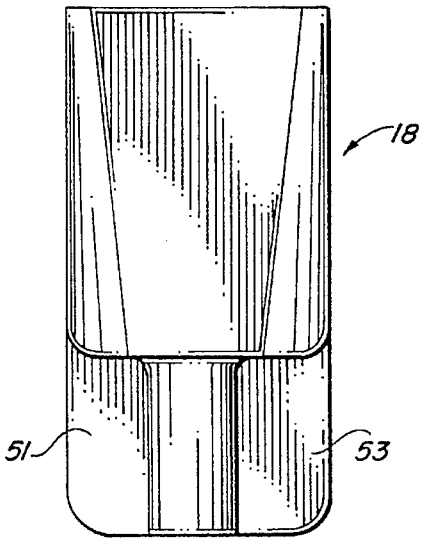
FIG. 5 is an elevation view of a swab shield.
Figure 6:
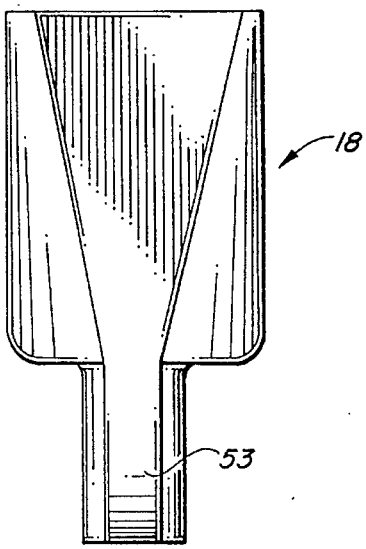
FIG. 6 is a side view of the device shown in FIG. 5.

The surface of the belly recess 20, shown in FIG. 2, may taper proximally somewhat, see FIGS. 5 and 6, for example.

Also, the hub portion 36 may be provided with two outwardly extending fins, such as 51 and 53, constituting means for gripping and manipulating the shield 18 for relative axial movement of the shield along the handle 25 to expose or to contain the daubing means and any daubing material thereon. The upper shield portion 34, see FIG. 2, which may be referred to as a daubing means skirt, is of an axial length between a) the shoulder 40 and b) the mouth of the belly recess 20, which is preferably greater than but at least the same as the axial length of the swab's distal end zone and daubing means so as to protect or jacket said swab's distal end zone.

Figure 8:
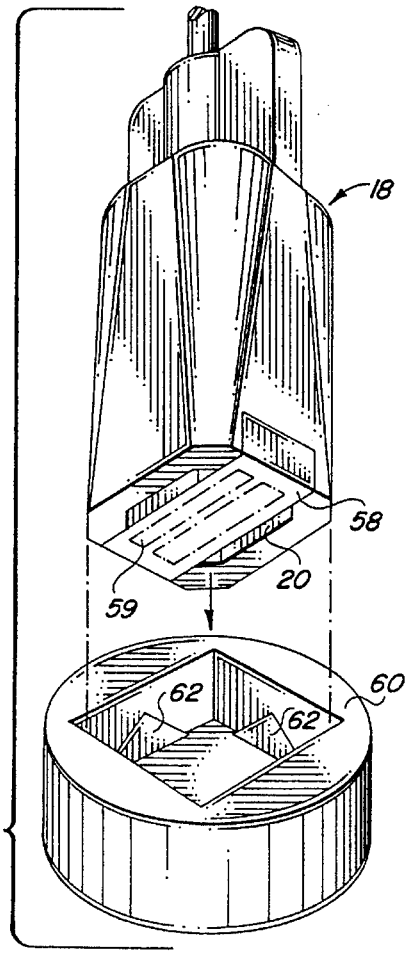
FIG. 8 is an exploded perspective view illustrating a device for opening an assembled swab and shield.

With respect to FIGS. 2 and 8, it is seen that the shield assembly can be provided with closure means 9 for closing the mouth of the belly 20 of the shield 18. It will be appreciated that the closure means will also act as holding means to constrain the daubing wad within the shield and further, may also act as sealing means for sealing the open mouth of the belly 20 of the shield 18 to prevent contamination of the daubing means 14, 16 which is normally enshrouded therein.

While a cap 9 as shown in FIG. 2 can be provided to close the mouth of the belly 20, FIG. 8 shows another closure means which may comprise a strip 58, of bendable material adhered to the shield 18, partially or fully closing the belly mouth. In this embodiment, the strip 58 can be easily disengaged from the shield; or, as shown in FIG. 8, a cutting device 60 can be used. For example, in FIG. 8, there is a tool 60 shown which is sized and configured to engage the shield structure about the belly mouth 20. The tool 60 or cutting device is provided with at least one tooth 62, of an overall size and configuration for puncturing said strip 58 and opening the belly mouth 20 of the shield, without damaging the daubing means 14, 16 and any daubable material 27 thereon. Said strip 58 may include identifying indicia 59 thereon.

Figure 9:
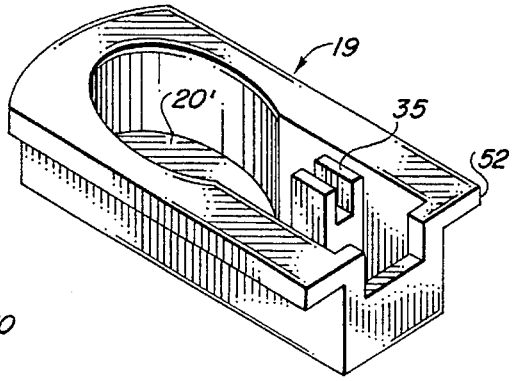
FIG. 9 is a perspective view of a first alternative embodiment of a swab.
Figure 10:
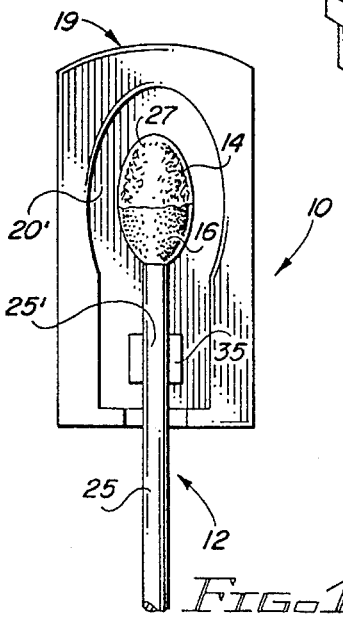
FIG. 10 is a plan view of the shield shown in perspective in FIG. 9 in combination with a swab captivated therein; the exterior of the swab's daubing means being partially broken away to expose the wad.
Figure 11:
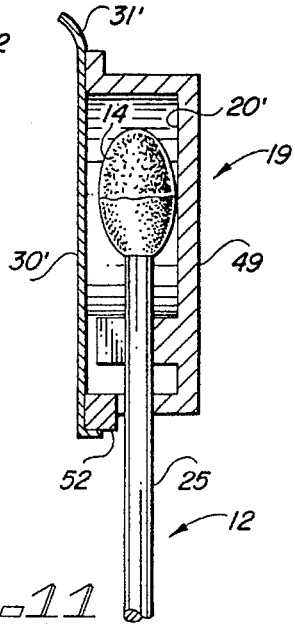
FIG. 11 is a view in cross-section taken on the center line of a second alternative embodiment quite similar to that of FIGS. 9 and 10 but which has a floor in the wad recess instead of a through recess.

Turning now to FIGS. 9–11, there are shown alternative embodiments of the swab and shield assembly. Once again, it is composed of a swab generally designated by the numeral 12 having a daubing wad 14 secured thereon. Since the preferred embodiment of the swab assembly, including the daubing means and daubable material to be applied thereon, have been adequately described in the preceding paragraphs, it will not be repeated here. Suffice it to say that in FIGS. 10 and 11, the swab's daubing wad 14 is shown to be protectively enshrouded by the body of the shield, 19. It will be noted in FIGS. 9 & 10 that the shield 19 includes a main internal recess 20' which may be a through recess, to, nevertheless, receive, jacket, and protectively enshroud the wad, daubing means and any daubing material thereon within the recess 20'. Within the recess, there is seen that holding means 35 may be provided which are sized to receive and embrace the rod of the swab 25 along a portion of its length 25' and to removably maintain said rod, wad and shield in assembly in generally co-axial alignment. The mutual cooperation of a) the surface of the rod handle 25, b) in the holding means 35 constitute mutually intercooperating means to limit axial movement of the daubing means and swab relative to each other. The embodiment of FIG. 11 provides a floor 49, which may be transparent, for the recess or belly 20'. It is also contemplated that the embodiments shown in FIGS. 9 & 11, each can be provided with sealing means, to protect the daubing means 14, 16 and any daubable material such as 27 thereon, from contaminants which sealing means may be of any type conventionally used in the art such as a cap or an envelope which can be easily removed. Shown in FIG. 11, a sealing means 30' in the form of a strip is shown, such as a foil strip. It can be adhered to the shield 19 to completely or partially close the mouth into the belly 20'. The strip 30' may include a tab 31' to initiate peeling of the strip 30' from sealing relation over the belly or main internal recess 20'. Also, the shield 19 may be provided with means for gripping and manipulating the shield, such as an outer lip 52, for movement out of assembly and exposing the daubing means 14, 16 and any daubable material thereon for use.

In the preferred embodiments, the smooth, outer surface of the daubing means may be comprised of a set mixture between 85% to 100% of a material selected from a wax like family which includes bees' wax, carnauba wax, candle wax, or micro crystalline. Further, the skirt of the shield may be composed of a plurality of spaced fingers, which may be outwardly flared, to generally resemble the pedals of a flower or other decortive arrangement. Finally, while a preferred daubing wad has been described, it will be appreciated that the working end of the swab rod or stick may be of other material such as might be done by dipping it in melted material and thereafter, allowing the same to set.

While this invention has been shown and described in what is considered to be a practical and preferred embodiments, it is recognized that departures may be made within the spirit and scope of this invention which should, therefore, not be limited except as set forth in the claims which follow and within the doctrine of equivalents.

What is claimed is:

1. A dauber assembly for use in picking up daubable material, comprising:

a disposable, sample swab having an enlarged, generally smooth-surfaced wad at one end and a rod having an exterior surface length extending away from the wad and defining a proximal end zone;

a rigid shield including:

a) a body about said wad having i) a main internal recess sized and configured to receive and protectively enshroud said wad therein, ii) an open mouth sized and configured to receive said wad for passage into said main internal recess;

iii) a passageway in open communication with said main recess, sized and configured to snugly receive said rod extending from said wad in embracing relation;

b) mutually intercooperating means on said body of said shield engaging a portion of said exterior surface length of said rod, adjacent said wad end for removably maintaining said rod, wad and shield in a first position wherein the rod, wad and shield are in generally co-axially alignment, releasable holding means about said shield and wad to constrain said wad and rod within the shield in said first position; and said proximal end zone extending away from said wad and shield comprising handle means to manipulate said swab relative to said shield for movement of said wad out of said main internal recess of said shield to separate said swab from said shield.

2. A dauber assembly as recited in claim 1, further including removable sealing means about said shield to prevent contamination of said disposable, sample swab.

3. A dauber assembly as recited in claim 2 wherein said rigid shield further comprises gripping means for manipulating and moving said shield from said first position of generally coaxial alignment into another position exposing the wad for use.

4. A dauber assembly for use in picking up daubable material comprising:

a) a disposable sample swab comprising an elongate rod having a distal end, a proximal end, a distal end zone adjacent said distal end, and a proximal end zone extending from said distal end zone to said proximal end, i) said proximal end zone having an overall length longer than said distal end zone and comprising a swab handle, ii) said handle of said rod being of a substantially uniform cross sectional area, b) daubing means for receiving a coating of daubable material at least partially thereon, said daubing means having a relatively smooth surface coating said distal end zone, c) a tubular shield having a through passageway circumposed about said swab, and having an exterior surface, said shield comprising:

i) a skirt portion with an enlarged recess forming a portion of said passageway and jacketing said daubing means, ii) a proximal hub portion having a portion of said passageway smaller in cross-section than said skirt recess and defining an annular shoulder at the juncture of the recesses, iii) said skirt recess having an annular inside surface sized and configured to receive, protectively enshroud and shield said distal end zone of said rod within said inside surface in spaced, close, adjacent relation to said daubing means and any daubing material thereon, iv) said hub portion of said passageway being sized for snug axial movement of said shield along said handle from a position with said skirt jacketing said daubing means and said shoulder adjacent said daubing means towards said proximal end of said handle to selectively expose said daubing means, v) said shield having an overall length less than the overall length of said handle and said exterior surface provided gripping means for manipulating relative axial movement of said shield and said swab.

5. A dauber assembly as recited in claim 4 wherein said distal end zone includes an enlarged portion at said handle comprising an abutment means to prevent axial movement of said daubing means into said hub portion.

6. A dauber assembly as recited in claim 4 wherein said tubular shield is integrally formed.

7. A dauber assembly as recited in claim 6 wherein said tubular shield is formed of a durable, rigid plastic material.

8. A dauber assembly as recited in claim 4 wherein said smooth surfaced daubing means of said swab is coated with a daubable material.

9. A dauber assembly as recited in claim 8 wherein the melting temperature of said smooth surfaced daubing means is substantially greater than that of a daubable material to be applied thereon at ambient temperature.

10. A dauber assembly as recited in claim 9 wherein the daubable material is a cosmetic.

11. A dauber assembly as recited in claim 5 further including means for substantially closing said enlarged recess of said skirt portion of said shield.

12. A dauber assembly as recited in claim 11 wherein said closure means is a cap.

13. A dauber assembly as recited in claim 11 wherein said closure means is a strip of lightweight flexible material.

14. A dauber assembly as recited in claim 13 wherein said material is of foil.

15. A dauber assembly as recited in claim 13 wherein said strip has indicia thereon.

16. A protective cover for a swab having a daubing wad at one end and an elongate rod terminating at another end of said swab, comprising:

a tubular shield having a through passageway circumposed about a wadded end of said swab, and having an exterior surface, said shield comprising:

i) a skirt portion with an enlarged recess forming a portion of said passageway to jacket said daubing wad end of said swab, ii) a proximal hub portion having a portion of said passageway smaller in cross-section than said skirt recess and defining an annular shoulder at the juncture of the recesses, iii) said skirt recess having an annular inside surface sized and configured to receive, protectively enshroud and shield said wad on said rod within said inside surface in spaced, close, adjacent relation to said daubing wad and any daubing material thereon, iv) said hub portion of said passageway being sized for snug axial movement of said shield along said rod from a first position with said skirt jacketing and shielding said daubing wad to another position axially along the rod away from the wad to selectively expose said daubing wad, and v) said shield having an overall length less than the overall length of said handle and said exterior surface provided gripping means for manipulating relative axial movement of said shield and said swab.

17. A shield assembly for a swab as recited in claim 16 wherein said tubular shield is formed of a durable, rigid plastic material.

18. A shield assembly for a swab as recited in claim 17 wherein said tubular shield is one piece.

* * * * *